US007497148B2

(12) United States Patent
Stucky

(10) Patent No.: US 7,497,148 B2
(45) Date of Patent: Mar. 3, 2009

(54) SWIVELING DRIVER

(76) Inventor: Andrew C. Stucky, 280 Shagbark Ridge La., Winchester, VA (US) 22602

( * ) Notice: Subject to any disclaimer, the term of this patent is extended or adjusted under 35 U.S.C. 154(b) by 0 days.

(21) Appl. No.: 11/454,023

(22) Filed: Jun. 15, 2006

(65) Prior Publication Data

US 2007/0289413 A1 Dec. 20, 2007

(51) Int. Cl.
*B25B 13/46* (2006.01)

(52) U.S. Cl. ..... 81/60; 81/177.8

(58) Field of Classification Search ..... 81/60, 81/62, 63.1, 177.7–177.9
See application file for complete search history.

(56) References Cited

U.S. PATENT DOCUMENTS 2,294,510 A * 9/1942 Nakano ..... 81/63
4,901,608 A 2/1990 Shieh
5,199,335 A 4/1993 Arnold et al.
5,870,932 A * 2/1999 Brooke ..... 81/177.8
6,105,770 A * 8/2000 Vasudeva ..... 206/378
6,167,787 B1 * 1/2001 Jarvis ..... 81/177.2
6,405,621 B1 * 6/2002 Krivec et al. ..... 81/177.9
2005/0029139 A1 * 2/2005 Chen ..... 206/373

* cited by examiner

*Primary Examiner*—D. S Meislin
(74) *Attorney, Agent, or Firm*—Dale J. Ream

(57) ABSTRACT

A swiveling driver includes a handle portion and a head portion operatively coupled to the handle portion for selectively pivoting relative thereto. The head portion includes an implement and defines at least one detent. A yoke extends from the handle portion and includes a protrusion for selective engagement with the detent. The yoke is movable between a locked configuration in which the protrusion is received in a detent and a released configuration in which the protrusion is not received in a detent. The head portion may be moved freely when the yoke is at the released configuration for setting the angle of the head portion relative to the handle or be fixed at the locked configuration. When the head portion is fixed, the implement may be operated with either a driver bit or in a ratcheting motion.

5 Claims, 6 Drawing Sheets

100

110
117
130
138
127
127a
120

100
110
113
118
112
115
116
120

100
110
112
115
116
130a
136a
130
126
136b
127
138
134
120

SWIVELING DRIVER

BACKGROUND OF THE INVENTION

This invention relates generally to hand tools and, more particularly to a swiveling driver having a head that both pivots and swivels for positioning a driver to engage a fastener and for selectively rotating a fastener with sockets or to turn a screw.

Fasteners such as bolts are frequently tightened and loosened using an implement which surrounds and grips an end of the fastener and rotates it in clockwise or counterclockwise directions to tighten or loosen the fastener, respectively. The implement described above is commonly a wrench or a ratchet wrench utilizing an appropriately sized socket to surround and grip the fastener. The ratchet mechanism enables repeated rotations to be made without continually turning a socket and then lifting and repositioning it. A socket wrench having a ratcheting mechanism may be repeatedly rotated both clockwise and counterclockwise but causing the fastener to actually be rotated in only one direction. A significant difficulty, however, is that a fastener may be situated at an odd angle such that getting and keep a wrench on the fastener is difficult.

Fasteners such as screws, however, usually include a head that may be rotated using a driver tool such as a screwdriver. Using a screwdriver or a driver bit enables this type of fastener to be initially installed and later adjusted very efficiently. A driver bit usually includes a tip that is complementary to the head of the fastener.

While both of these tools (a ratchet wrench and a screwdriver) are known in the art and effective for their intended purposes, it would be desirable to have a swiveling driver that may be selectively utilized to drive a fastener. Further, it would be desirable to have a swiveling driver having a head that selectively swivels and pivots relative to a handle for positioning the head in relation to a fastener. Further, it would be desirable to have a swiveling driver in which the head may be fixed in a plurality of positions and utilized selectively with a ratcheting or drive bit implement for manipulating a fastener.

SUMMARY OF THE INVENTION

Accordingly, a swiveling driver according to the present invention includes a handle portion and a head portion pivotally coupled to the handle portion. The head portion may be selectively pivoted to a desired position relative to the handle. The head portion includes a generally flat face and includes an implement extending therefrom. The implement may itself be a screwdriver or may have a configuration capable of coupling to another implement accessory such as a socket or other driver bit. The implement includes a ratchet assembly The head includes a rounded portion extending rearward from the flat face, the rounded portion defining at least one detent.

The swiveling driver includes a yoke extending from an end of the handle portion and including a protrusion having a configuration complementary to that of the at least one detent for being selectively received therein. The head is movable relative to the yoke between a release configuration in which the protrusion is not received in the detent and a lock configuration in which the protrusion is received in the detent. This enables the head portion to be releasably held at a fixed position or, selectively, to enable the head portion to swivel with a wide range of motion such as a ratcheting motion. A switch is utilized to regulate the head between locked and released configurations.

In use, the head portion may be released to move freely so as to move to a desired angle relative to the handle portion. Then the head portion may be fixed at a desired angle relative to a fastener. Then, an implement such as a screwdriver bit may be utilized as the implement to rotate a fastener such as a screw. Or, the implement may be coupled to a ratchet accessory and used for a ratcheting motion.

Therefore, a general object of this invention is to provide a swiveling driver for rotating a fastener.

Another object of this invention is to provide a swiveling driver, as aforesaid, having a head that selectively pivots for positioning a head at a desired position for properly addressing the fastener.

Still another object of this invention is to provide a swiveling driver, as aforesaid, having a head that selectively swivels for positioning a head at a desired position for properly addressing the fastener.

Yet another object of this invention is to provide a swiveling driver, as aforesaid, having an implement that is a screwdriver or that may be coupled to a screwdriver or other driver bit.

A further object of this invention is to provide a swiveling driver, as aforesaid, having an implement that may be coupled to a socket.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A swiveling driver 100 according to the present invention will now be described in detail with reference to FIGS. 1*a* through 6*d* of the accompanying drawings. More particularly, a swiveling driver 100 according to the current invention includes a head portion 110 and a handle portion 120.

Figure 1A:
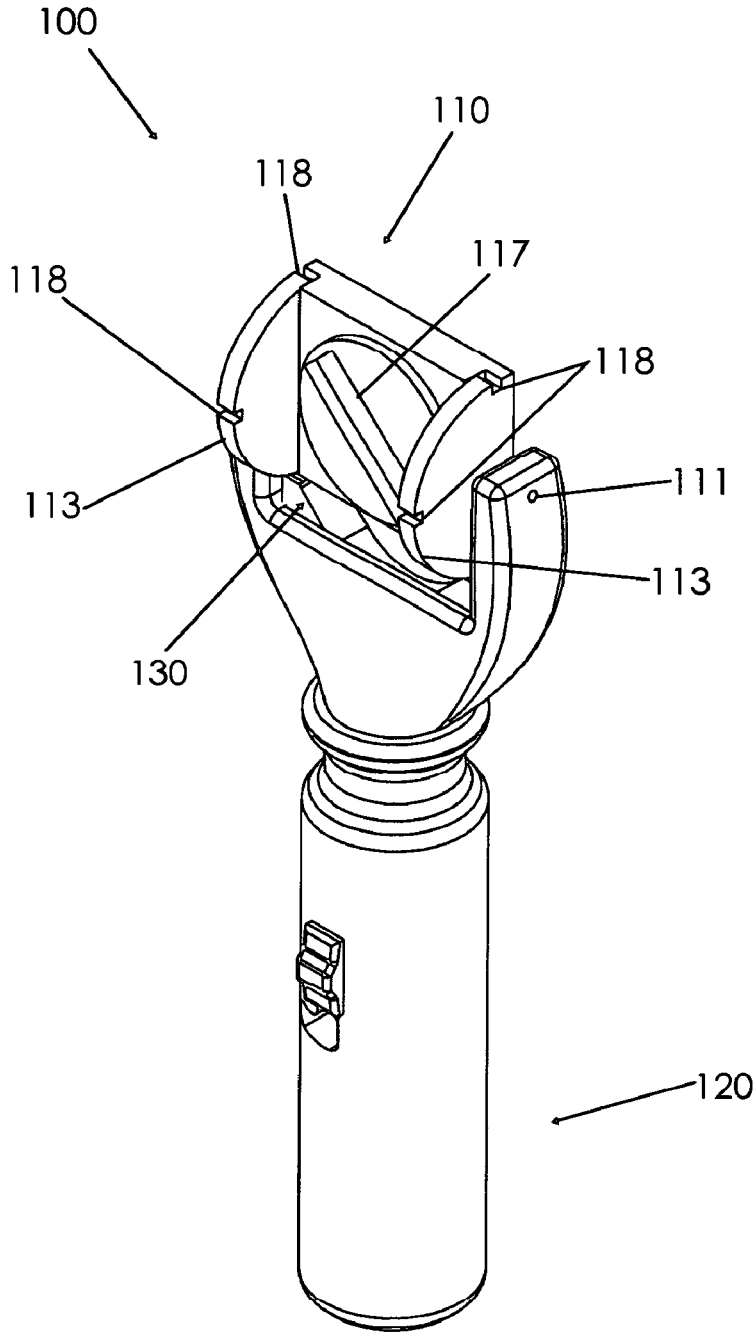
FIG. 1 is a perspective view of a swiveling driver according to a preferred embodiment of the present invention.

The head portion 110 is operatively coupled to the handle portion 120 for selective pivoting or rotation relative to the handle portion 120 (i.e., by pins 111 shown in FIG. 1*a*). More particularly, a pair of arms extend upwardly from an upper end of the handle portion 120 in a generally U-shaped configuration, each arm having a free end. An imaginary axis (hereinafter referred to as a centerline axis) extends between the pins 111 such that the head portion is rotatable 360 degree about this centerline axis. This centerline axis is perpendicular to the handle portion 120 and, more particularly, to a longitudinal axis defined by the handle portion 120. The head portion 110 has an implement 115 (FIGS. 2*b* through 3*b*) and at least one detent 118 (shown throughout the drawings). The implement 115 may be a ratcheting implement 115 (as shown in the drawings,) and may be driver bit 116 or a screwdriver bit, for example. The driver bit 116 may present a male configuration (as shown) or a female configuration, and may, for example, receive or otherwise couple a socket, screwdriver bit, etc. to the head portion 110.

Figures 2A, 2B, 2C:
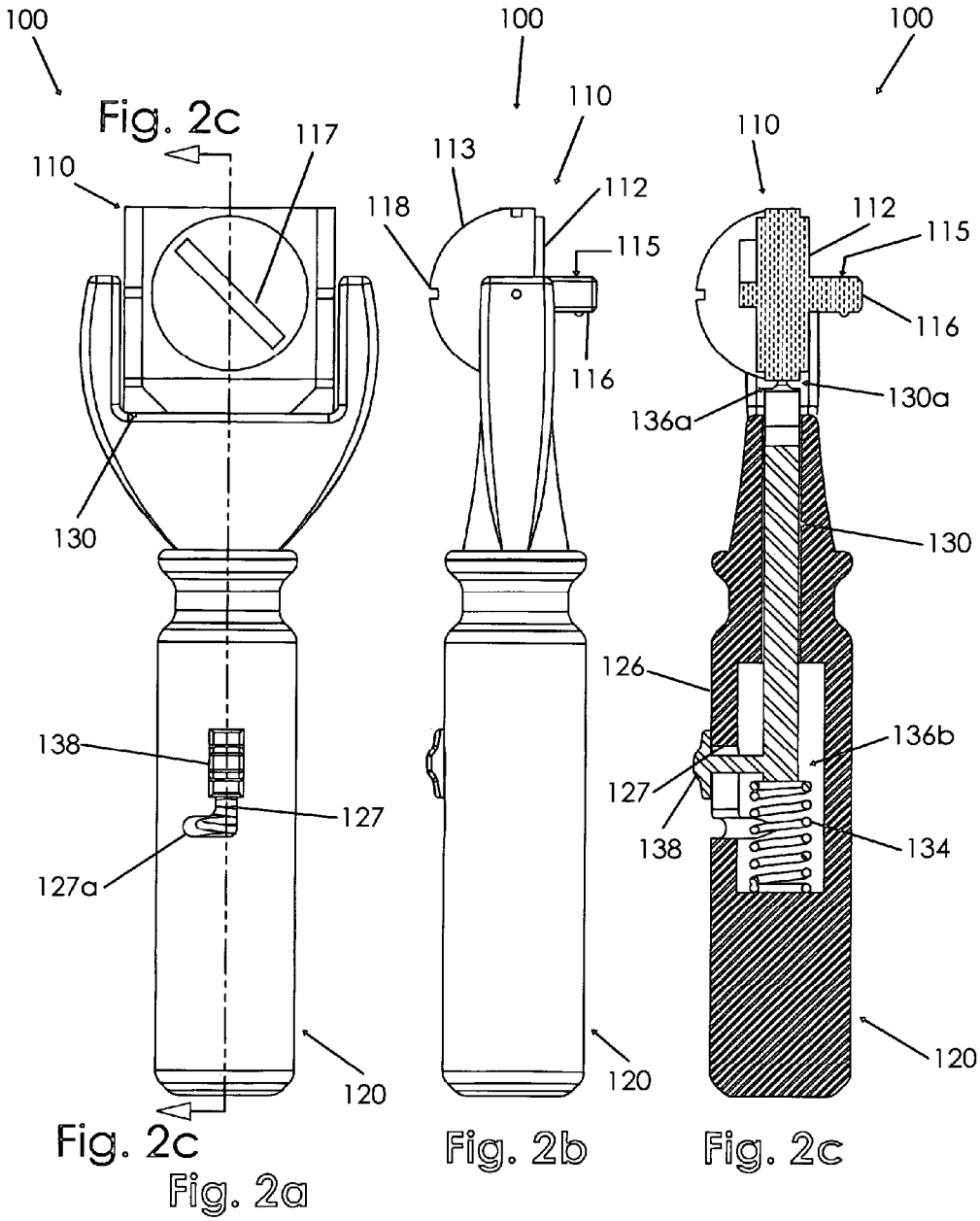
FIG. 2*a* is a rear view of the swiveling driver as in FIG. 1 with a head portion in a front facing configuration.
FIG. 2*b* is a side view of the swiveling driver as in FIG. 2*a;*
FIG. 2*c* is a sectional view taken along line 2*c*-2*c* of FIG. 2*a;*
Figure 3A:
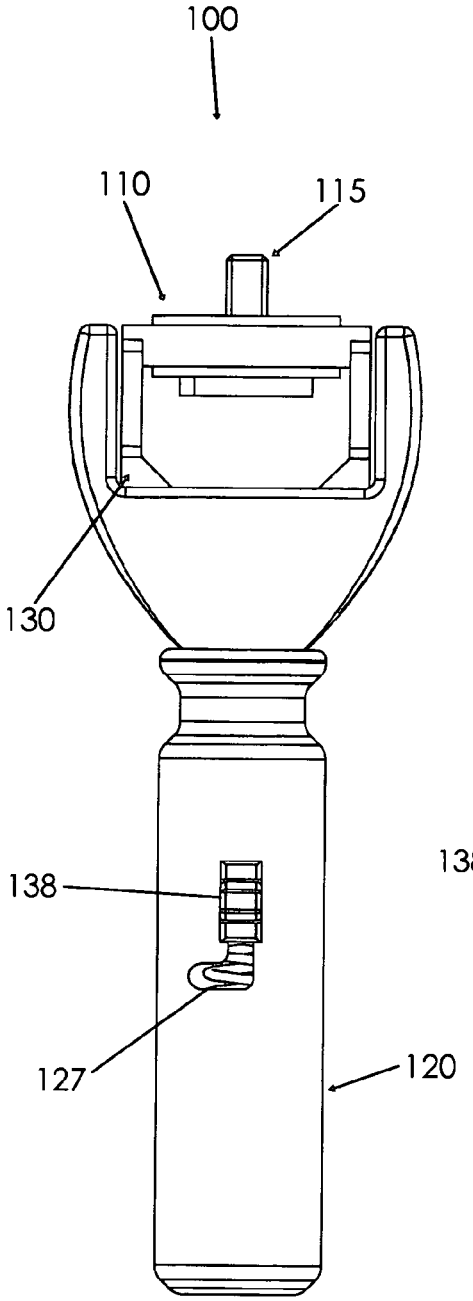
FIG. 3*a* is a rear view of the swiveling driver as in FIG. 1 with the head portion in an upward facing configuration.
Figure 3B:
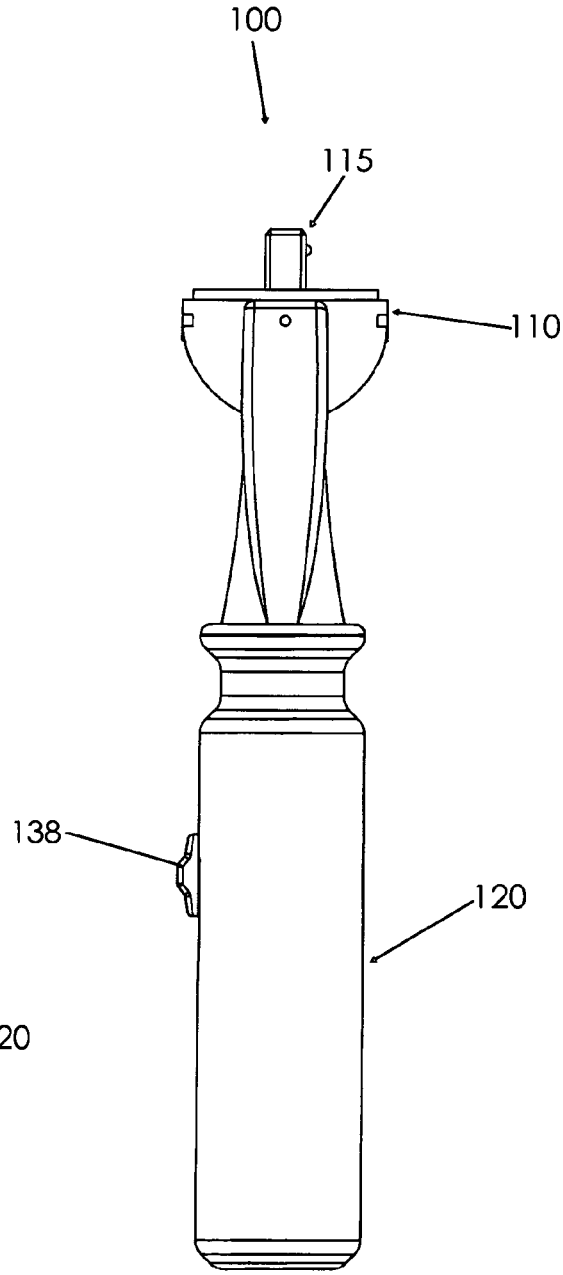
FIG. 3*b* is a side view of the swiveling driver as in FIG. 3*a;*

The head portion 110 may have a substantially planar face surface 112. A rounded outer surface 113 may extend opposite from the face surface 112 and define the detent(s) 118. The implement 115 may extend from the face surface 112 opposite the rounded outer surface 113, as shown in FIG. 2*b* for example. The ratcheting implement 115 may have a ratchet selection member 117 that allows a user to select a ratcheting configuration (e.g., clockwise, counterclockwise), and the ratchet selection member 117 may be accessible adjacent the rounded outer surface 113 (FIG. 1*a*).

Figure 4A:
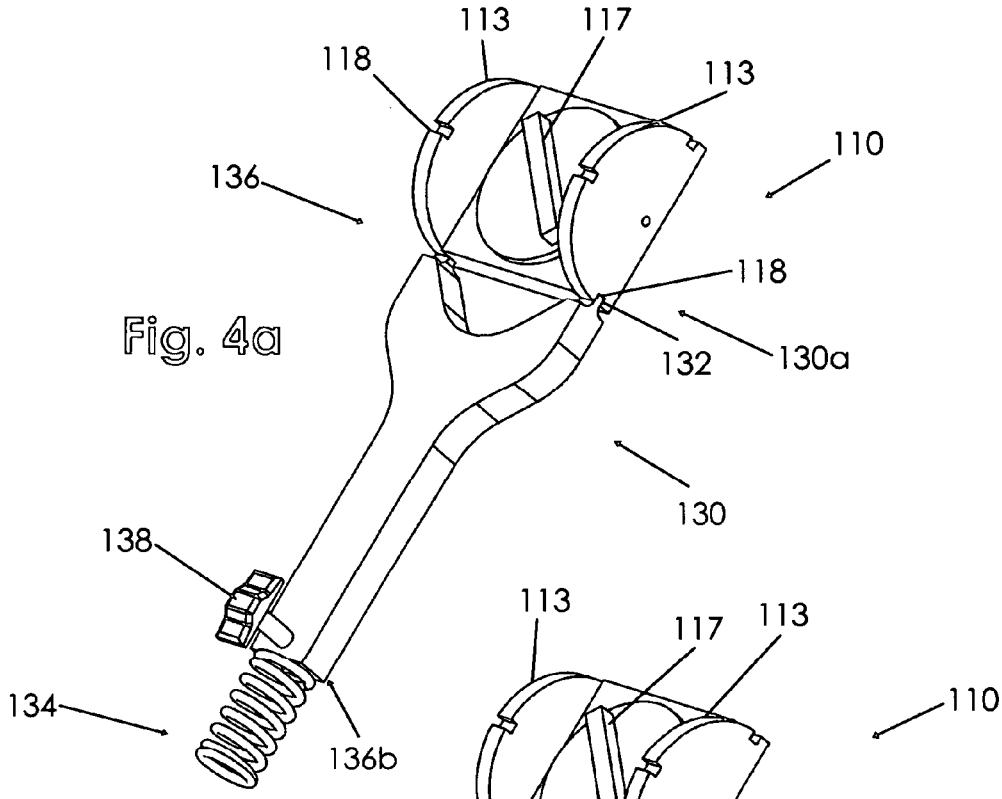
FIG. 4*a* is a perspective view of the yoke as in FIG. 1 removed from the handle portion and illustrating the head portion and yoke at a lock configuration.
Figure 4B:
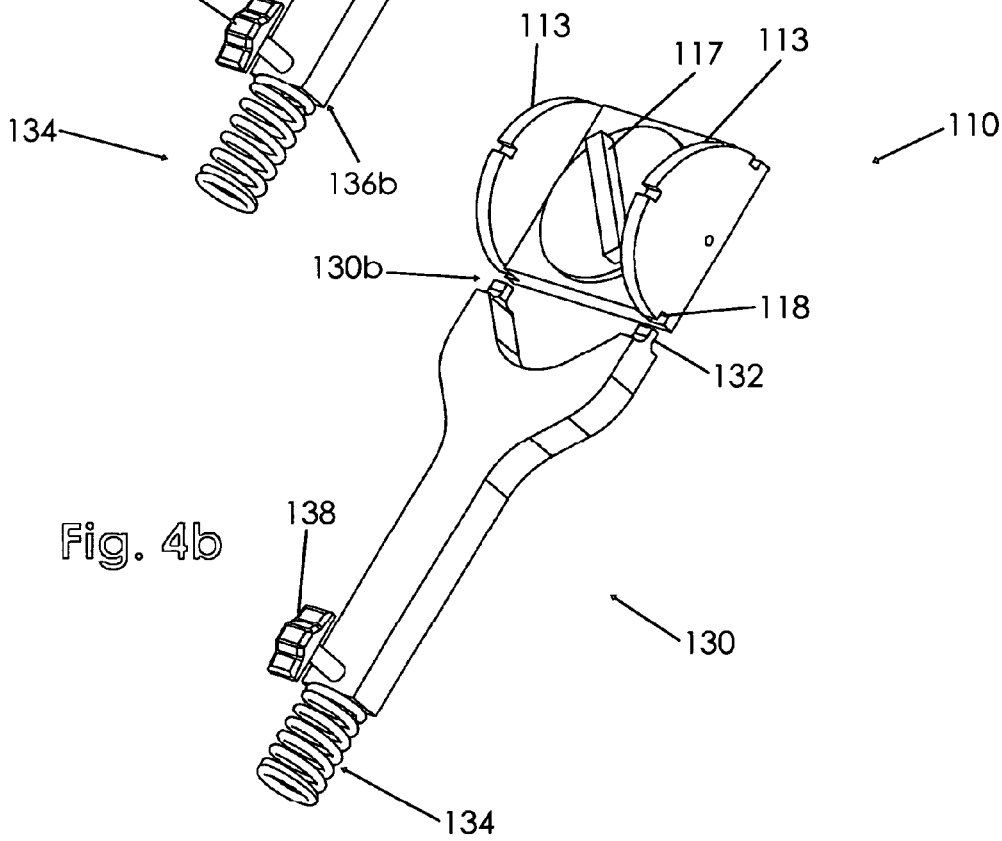
FIG. 4*b* is another perspective view as in FIG. 4*a* with the head portion and yoke at a release configuration.

Means for selectively maintaining the head portion 110 in a fixed position relative to the handle portion 120 may be included. More particularly, a yoke 130 may extend from the handle portion 120 (FIG. 2*c*). As shown in FIGS. 4*a* and 4*b*, the yoke 130 may have a protrusion 132 complementary to the detent(s) 118 defined by the head portion 120, and the yoke 130 may be movable between a release configuration 130*b* (FIG. 4*b*) in which the protrusion 132 is not receivable in the detent(s) 118 and a lock configuration 130*a* (FIG. 4*a*) in which the protrusion 132 is receivable in the detent(s) 118. If a plurality of detents 118 are included, the yoke 130 may selectively maintain the head portion 110 in a plurality of fixed positions relative to the handle portion 120.

As best shown in FIG. 2*c*, a spring 134 may bias the yoke 130 toward the lock configuration 130*a*. The handle portion 120 may have a sidewall 126 defining a switch opening 127, and the yoke 130 may have first and second ends 136*a*, 136*b*. The protrusion 132 may be adjacent the first end 136*a* of the yoke 130, and the second end 136*b* of the yoke 130 may extend into the handle portion 120. A switch 138 may extend from the yoke second end 136*b* through the switch opening 127 for moving the yoke 130 between the release configuration 130*b* and the lock configuration 130*a*. As shown in FIG. 2*a*, the switch opening 127 may have an offset portion 127*a*, and the switch 138 may maintain the yoke 130 at the release configuration 130*b* when the switch 138 is at the offset portion 127*a* of the switch opening 127.

Figure 5:
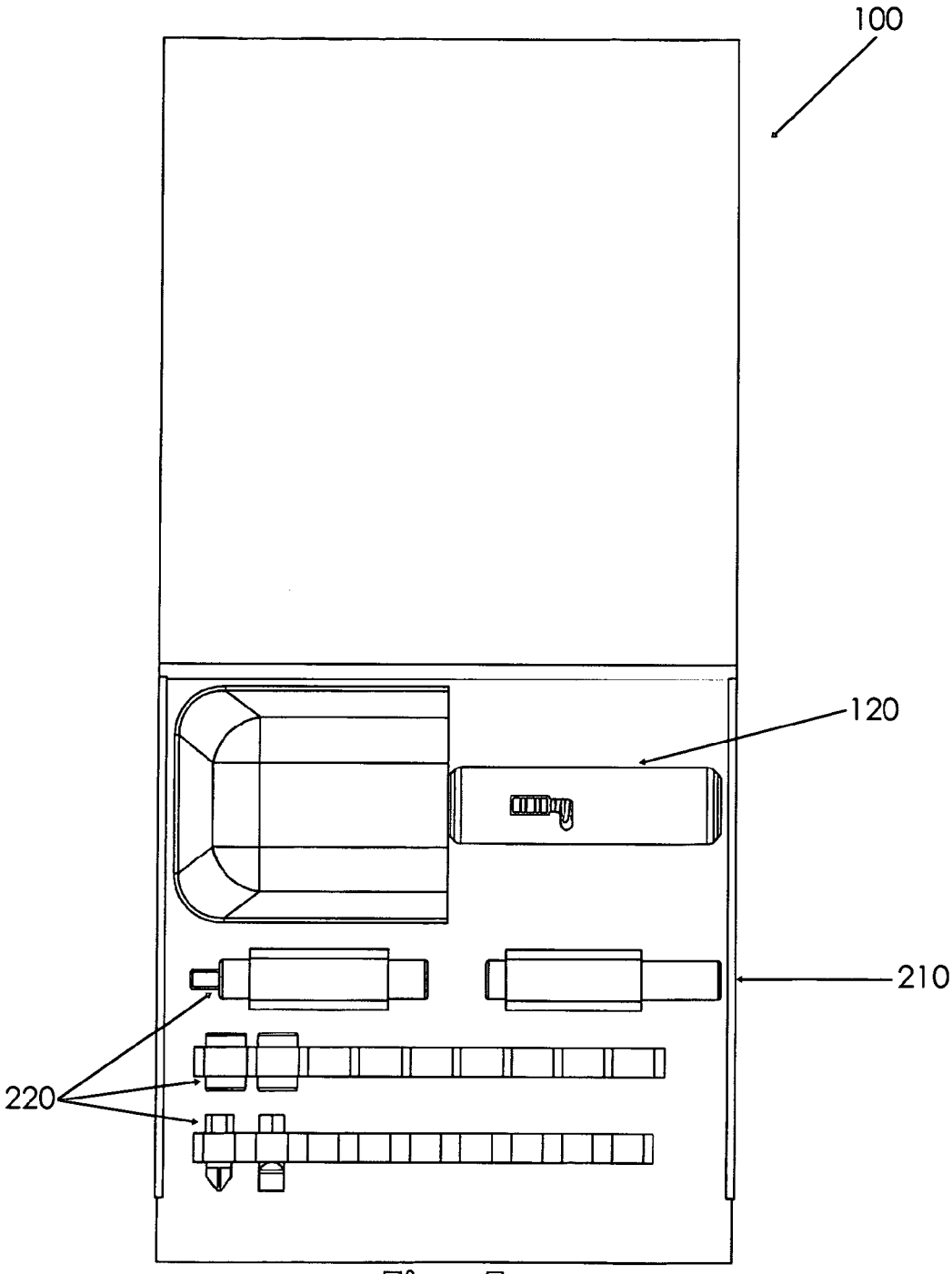
FIG. 5 is a top view of a case having a plurality of elements shown with a lid in an open configuration.
Figure 6A:
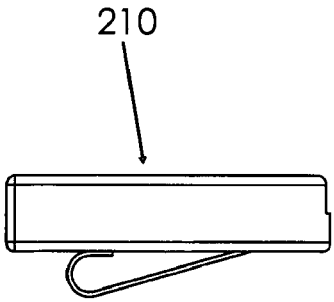
FIG. 6*a* is a side view of the case as in FIG. 5 with the lid in a closed configuration.
Figure 6B:
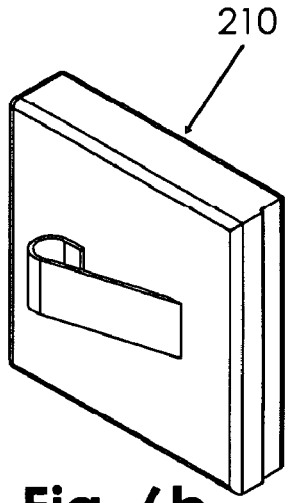
FIG. 6*b* is a rear perspective view of the case as in FIG. 6*a;*
Figure 6C:
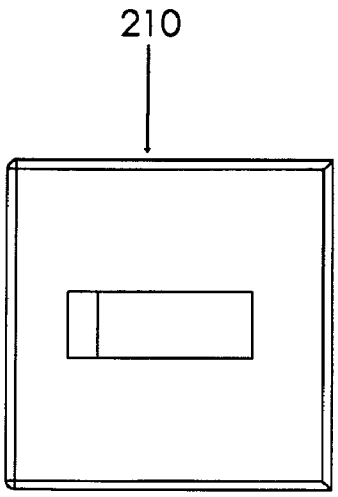
FIG. 6*c* is a bottom view of the case as in FIG. 6*a;*.
Figure 6D:
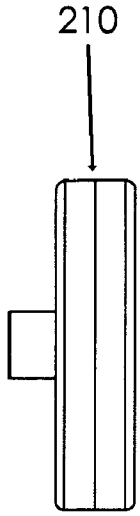
FIG. 6*d* is a front view of the case as in FIG. 6*a.*

FIGS. 5 through 6*d* show that the driver 100 may further include a case 210 and a plurality of elements 220 complementary to the ratcheting implement 115, such as sockets, screwdriver bits, bit adapters, and extensions. The case 210 may have means for securing the head portion 110, the handle portion 120, and/or the complementary elements 220, such as pockets, indentations, or straps. The case 210 may also have a belt clip 212 for removably securing the case to a user's belt.

In use, the user may move the yoke 130 to the lock configuration 130*a* (FIG. 4*a*) or the release configuration 130*b* (FIG. 4*b*) using the switch 138. To move the yoke 130 to the lock configuration 130*a*, the switch 138 may be removed from the offset portion 127*a* of the switch opening 127, and the spring 134 may bias the yoke 130 toward the head portion 110. The protrusion 132 may mate with a detent 118 when the yoke 130 is so biased to fix the position of the head portion 110 relative to the handle portion 120. Depending on the placement of the detent(s) 118, the user may move the yoke 130 to the lock configuration 130*a* so that the implement 115 is parallel to the handle portion 120 (FIGS. 3*a* and 3*b*) or so that the implement 115 is perpendicular to the handle portion 120 (FIG. 2*c*). If the implement 115 is a ratcheting implement, the ratchet selection member 117 may be adjusted to select a ratcheting configuration as discussed above. The complementary elements 220 may be coupled to the implement 115 as discussed above.

To allow the head portion 110 to swivel relative to the handle portion 120, the yoke 130 may be moved to the release configuration 130*b* by moving the switch 138 to the offset portion 127*a* of the switch opening 127, effectively compressing the spring 134. While the yoke 130 is at the release configuration 130*b*, a large range of motion is provided for the user; implement 115 may allow ratcheting motion and the head portion 110 may be swiveled relative to the handle portion 120. The case 210 may be used for storage and organization.

It is understood that while certain forms of this invention have been illustrated and described, it is not limited thereto except insofar as such limitations are included in the following claims and allowable functional equivalents thereof.

What is claimed is as follows:

1. A swiveling driver, comprising:

a handle portion defining a longitudinal axis;

a pair of arms extending upwardly from an upper end of said handle portion, said arms having respective free ends and said free ends establishing an imaginary centerline axis therebetween that is generally perpendicular to said longitudinal axis of said handle portion;

a head portion operatively coupled to said free ends of said arms for selective pivotal movement about said centerline axis such that said head portion is rotatable 360 degrees relative to said centerline axis;

wherein said head portion includes:

a substantially planar face surface and a pair of rounded outer surfaces that are spaced apart and parallel one to the other and that extend away from said face surface and that define a plurality of spaced apart detents;

ratcheting implement extending from said face surface opposite said rounded outer surfaces;

a ratchet selection button positioned adjacent said rounded outer surfaces;

a yoke extending from said handle portion, said yoke having a pair of protrusions complementary to said detents for selectively maintaining said head portion in a fixed position relative to said handle portion;

wherein each said protrusion is positioned immediately adjacent a respective arm and a respective rounded outer surface such that each protrusion does not extend substantially laterally from a respective arm;

wherein said yoke is movable between a release configuration in which said protrusions are not receivable in respective detents and a lock configuration in which said protrusions are receivable in said respective detents; and wherein a spring biases said yoke toward said lock configuration.

2. The driver of claim 1, wherein:

said handle portion has a sidewall defining a switch opening;

said yoke has first and second ends;

said protrusions are adjacent said yoke first end;

said yoke second end extends into said handle portion; and a switch extends from said yoke second end through said switch opening for moving said yoke between said release configuration and said lock configuration.

3. The driver of claim 2, wherein:

said switch opening has an offset portion; and said switch maintains said yoke at said release configuration when said switch is at said offset portion of said switch opening.

4. The driver of claim 1, wherein said ratcheting implement is selected from the group consisting of a screwdriver bit and a driver bit.

5. The device of claim 1 further comprising a case having means for securing at least one item selected from the group consisting of said handle portion, said head portion, and a plurality of elements thereto.

* * * * *